United States Patent [19]

Moore

[11] 3,979,870

[45] Sept. 14, 1976

[54] LIGHT-WEIGHT, INSULATED CONSTRUCTION ELEMENT AND WALL

[76] Inventor: Alvin Edward Moore, Manini Way, Diamondhead, Rte. 1, Bay St. Louis, Miss. 39520

[22] Filed: Jan. 24, 1975

[21] Appl. No.: 543,661

[52] U.S. Cl. ..... 52/577; 52/576; 52/DIG. 9; 52/615; 52/443; 52/382; 52/309

[51] Int. Cl.[2] ..... E04C 1/06; E04C 1/16

[58] Field of Search ..... 161/68, 69, 135; 52/576, 577, 615, 443, 445, 315, 613, 380–382, DIG. 9; 181/336, 336 A

[56] References Cited

UNITED STATES PATENTS

| | | | |
|---|---|---|---|
| 1,465,653 | 8/1923 | Olander | 52/382 |
| 1,477,520 | 12/1923 | Pittman | 52/576 |
| 1,538,681 | 5/1925 | Buckhout | 52/382 |
| 2,043,445 | 6/1936 | Oxhandler | 181/33 G |
| 2,477,852 | 8/1949 | Bacon | 181/33 G |
| 2,924,962 | 2/1960 | Nettle | 52/577 |
| 3,721,059 | 3/1973 | Reynolds | 52/577 |

FOREIGN PATENTS OR APPLICATIONS

| | | | |
|---|---|---|---|
| 254,474 | 9/1966 | Austria | 52/577 |
| 1,105,738 | 9/1955 | France | 52/DIG. 9 |
| 869,392 | 5/1961 | United Kingdom | 52/DIG. 9 |

*Primary Examiner*—Ernest R. Purser
*Assistant Examiner*—Robert C. Farber

[57] ABSTRACT

An insulated bar or panel, usable in walls, ceilings-floors or roofs, including new or used cans of metal, glass or plastic, preferably having lengths less than twelve times their diameters, containing insulation (preferably inexpensive insulation such as loose earth, pumice or crushed lava, tanbark, small lumps of pine or other bark, slightly charred sawdust, bits of charcoal or coke, preferably preservative treated cottonseed or rice hulls or the like, cotton linters or bolls, tufts of cotton or rockwool, or vermiculite). The cans, which for example may be of paint-containing or coffee-containing type, are end-joined in a line. They are imbedded in a shape-holding matrix of plastic material (preferably porous, foamed plastic or porous concrete of portland, epoxy or other cement, mixed with lightweight aggregate, thus forming a strong, elongated bar or panel. Each adjacent pair of the can-end caps are fastened together — preferably by a band of adhesive tape encompassing the rims of the can ends, but optionally by solder, epoxy putty or other bonding material. Optionally, the cans may be in two sizes, with an end cap of each smaller can epoxy-glued or soldered in the end recess of an end cap of a larger can. The invention includes a wall (upright wall, ceiling, floor or roof) of the construction elements, laid with mortar between them, and stuccoed, plastered or painted on one or both sides, and a method of making it and the can-containing element.

10 Claims, 11 Drawing Figures

FIG. 1
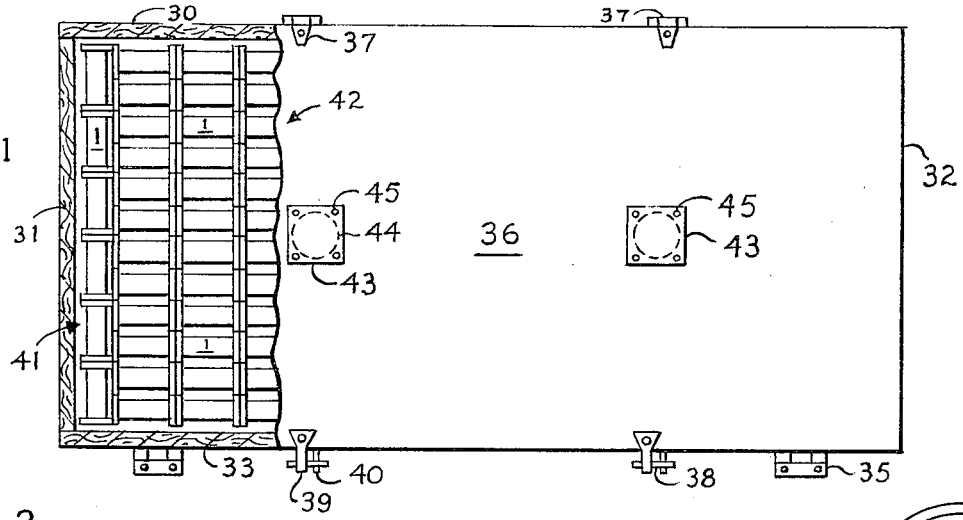
FIG. 2
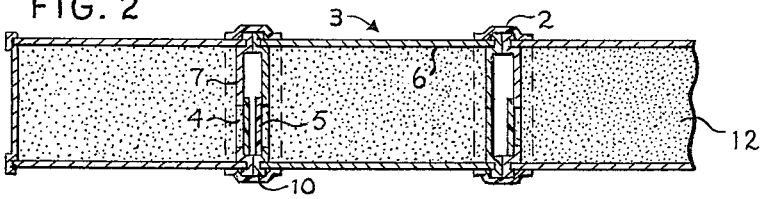
FIG. 3
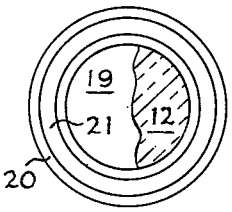
FIG. 4
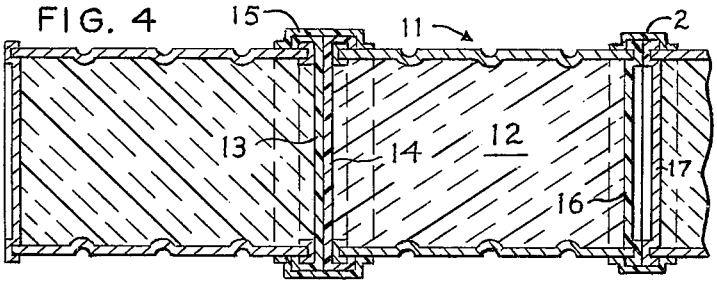
FIG. 5
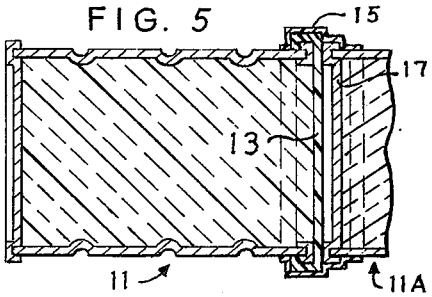
FIG. 6A
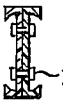
FIG. 6
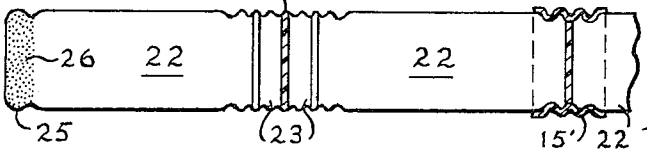
FIG. 7
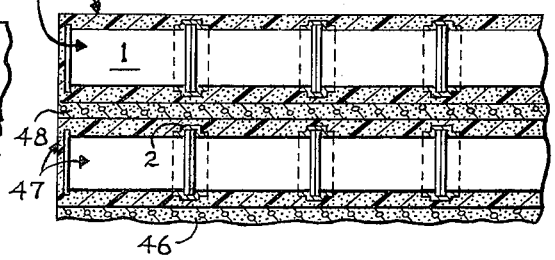
FIG. 8
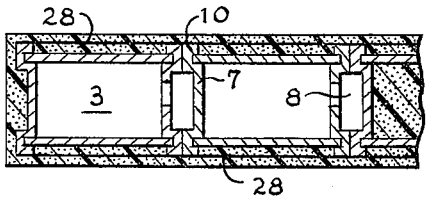
FIG. 9
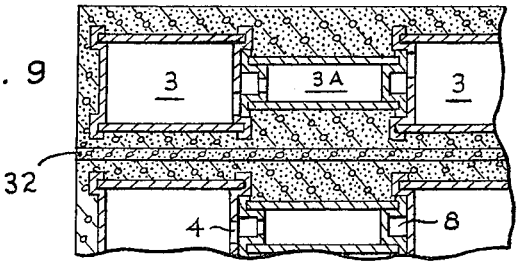
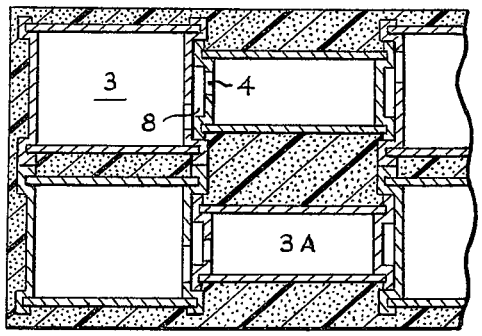
FIG. 10

LIGHT-WEIGHT, INSULATED CONSTRUCTION ELEMENT AND WALL

This invention pertains to a light-weight, insulated construction element and a method of making it. The present application is a continuation-in-part of application Ser. No. 359,800 (U.S. Pat. No. 3,878,661), filed on 14 May, 1973, which was a continuation of application Ser. No. 102,317, filed on 29 Dec., 1970, division having been required between inventive matter now claimed in application Ser. No. 359,800 and inventive features of the present case. These features taken from the prior applications are: the mold and method of present FIG. 1; the construction elements of FIGS. 8 to 10; and, in general, the invention of cans, containing thermal insulation, fastened together in end-to-end relation, and sheathed in shape-holding, thermally insulating material.

There has long been a need in construction of houses, mobile homes, trailers, boats and other vehicles of a long, insulated construction bar or panel, light enough in weight to be handled easily in building operations, yet strong enough for a strength-providing wall, and easily establishing exterior and interior lines of the house or other construction. Another long-existent need is a solution of the waste and disposal problem of used cans.

In view of these facts, some objects of the present invention are: (1) to provide an elongated construction element of insulation-containing cans, new or used, joined and fastened together in end-to-end relation and sheathed in a matrix of porous, insulating, shape-holding material; (2) provision of such a construction element in which each coaxial set of the cans comprises cans of different diameters, with inwardly-recessed end caps, and the cans of the smaller diameters have end caps fitting within recesses of the larger cans; (3) provision of the construction element of (1) above, in which each coaxial set of the cans have equal diameters, and each can comprises a tube and a pair of end caps which project outward of the tube, and the cans are held together by pieces of slightly stretchable adhesive tape, wrapped around each pair of adjoined end caps and stretched in its middle part to snugly encase the end caps as well as adjacent portions of the can tubes; (4) provision of the construction element of (1) above, in which the cans are jars or bottles, having screw-threaded end caps that are fastened together. These and other objects of the invention are indicated in the following specification and the attached drawings.

In these drawings:

FIG. 1 is a plan view, partly broken away in section along a horizontal plane, showing a plurality of end-joined cans in a mold before the fluent mixture of porous-plastic materials is inserted into the mold;

FIG. 2 is a fragmentary sectional view of an end-joined, coaxial set of the insulation-containing cans, held together by electrical insulation or other adhesive tape;

FIG. 3 is a plan view of an optionally used common type of can, containing insulation;

FIG. 4 is a fragmentary sectional view of an end-to-end-joined set of insulation-containing cans of the coffee-containing type, held together by stretchable adhesive tape;

FIG. 5, similar to FIG. 4, shows an alternative assembly of tape-joined, coffee-containing-type cans;

FIG. 6 is a fragmentary sectional view of end-joined jars or bottles;

FIG. 6A is a sectional view, illustrating an optional method of fastening together removable end caps of cans;

FIGS. 7 and 9 are fragmentary sectional views of bars or porous-material-sheathed, end-joined caps, illustrating two types of junction of the can ends, the bars being laid in a wall with mortar between them;

FIG. 8 is a fragmentary view, in section from a plane containing the can axes, indicating a bar or panel, comprising end-to-end-arranged cans, in a matrix of molded porous material; and FIG. 10 is a fragmentary, sectional view of a panel or bar having two parallel rows of cans in molded material (here exampled as foamed plastic).

In each of the construction elements illustrated in FIGS. 1 to 10 and described below: the matrix of shape-holding molded plastic material optionally may be foamed plastic or concrete (when of concrete, preferably of light-weight, porous, insulating type); the cans preferably are cylindrical and of metal, but optionally may be of dense, strong plastic or of glass (jars, bottles, or the like); and the insulation which preferably is in the cans of each of FIGS. 1 to 6 and 7 to 10 may be of any known type. But preferably the insulation used is relatively inexpensive — for examples: preservative-treated or slightly charred sawdust; shredded cedar, cypress or other bark; spent tankbark; bits of pine bark of the type commonly used as mulch; light-weight top-soil or other dirt or dust; ashes or cinders; bits of charcoal or coke; preservative-treated cotton linters or bolls; preservative-treated rice hulls, cottonseed hulls or other seed or nut hulls; vermiculite; tufts of rock wool or the like; crushed lava rock, expanded baked clay or shale.

FIG. 7 illustrates stacked construction elements, held together by layers of mortar. The cans 1 may be any known type of can, jar or bottle, each row of which is end-joined by epoxy putty or other glue, and/or the bolts or rivets of FIG. 6A, and/or the pieces of adhesive tape (2, 15 and 15') of FIGS, 2, 4, 5, 6 and 7. When the cans are of the same diameter, this fastening means, between each adjacent pair of can ends, preferably is a piece of slightly stretchable adhesive tape. Epoxy putty or other pasty glue may first be applied between the can ends and then the tape wrapped around them. But preferably only adhesive tape is used. The present inventor has discovered that, surprisingly, a row of the cans, end-joined by masking, plastic or friction tape (or other slightly stretchable adhesive tape) is very strong and adapted to be sheathed in a matrix of shape-holding, molded material. Masking tape, inexpensive and widely sold, is preferred.

The cans 1 may be of the type shown at 3 in FIGS. 2 and 8 to 10, which is commonly used to contain liquids. Although they may be new they preferably are used cans that have contained beer or soft drinks. When the insulation used is easily poured out of the cans (for example, vermiculite, sawdust, or preservative-treated rice or cottonseed hulls, or loose dry earth) the opening 4 in a can-end cover is preferably closed by a bit of masking or other adhesive tape, 5. Preferably, the rolls of this tape are punctured in triangular lines, so that triangles of the tape may be easily detached from a tape roll, without waste of material. Each of the cans 3 comprises a tube 6 and at each end of this tube an end cover 7, which has an end recess 8. As illustrated in FIGS. 9 and 10, the cans are of different diameters and end caps of the smaller cans 3A fit inside recesses of the larger cans 3; and they are glued in place by epoxy putty, silicone-rubber cement or other adhesive. As shown in FIG. 2, the cans are of equal diameters, and optionally may have their end covers glued together by epoxy putty or the like; but in any event they are fastened together by pieces of adhesive tape 2 which are wrapped tightly around and encompass the end caps 7. These end caps preferably project beyond the outlines of the can tube, providing rims 10 of the cans; and in wrapping the tape around the can ends its middle part slightly stretches at these rims, so that it arches over them. Thus, when pressure is applied to a middle portion of a can row the cans do not break apart, for the tape strongly binds the rims together. It has portions on each side of the middle circle of the rims which adhesively grip cylindrical portions of the can tubes as well as side portions of the rims.

Optionally — and preferably at present — the cans 1 of FIG. 7 may be of the type shown at 11 in FIGS. 4 and 5. This can is of the common, corrugated, enameled, coffee-containing kind, and preferably is used; it is filled with insulation 12 and closed at its opened end by the plastic cap 13 which is a part of the commonly sold can assembly. In FIG. 4 the two plastic caps 13 and 14 are contiguous; and the piece of adhesive tape 15, which is wider than the adhesive strip 2 of FIGS. 2 and 4, is tautly wrapped around the rims of 13 and 14, and stretched at its middle, rim-encircling portion so as to tightly grip the outermost, annular surface of the rims, as well as their side surfaces. Adhesive bands 15 thus join a plurality of pairs of the corrugated cans; and a number of these pairs are end-joined to form an elongated tubular member, as indicated in the right-hand portion of FIG. 4. Here metallic end caps 16 and 17 of two of the pairs of cans are contiguous; and, optionally with or without application of glue between the end caps, their rims are tautly encircled by the adhesive tape 2, which stiffly stretches at its middle portion to arch over the outer rim surfaces, while parts of its side portions grip side surfaces of the rims and other parts tightly and adhesively adhere to cylindrical portions of the can tube. This joint is similar to the junction between the cans of FIG. 2. In FIGS. 2, 4, 5 and 7, after the adhesive tape is wrapped around the abutting can ends it is further applied to the rims in an overlapping tape portion. If desired for extra strength the tape may encircle the can ends twice; or a wider piece of tape may be wrapped around a narrower tape band; but at present this is not deemed necessary.

In each of the figures the light-weight, elongated tubular members of joined cans are preferably at least 5 feet long when they are at the sides of window or door frames or in closet walls. And when a tubular member is in a bar above or below a window or door frame, or used as a ceiling joist or rafter, it has the entire desired length of the wall, ceiling joist, or rafter.

The tubular member or can row of FIG. 5 has an optionally different type of joint between can ends from that of FIG. 4. In FIG. 5, at each adjacent pair of can ends of the elongated tubular member, the plastic cap 13 which snaps over and covers the open end of the can 11 is contiguous with the metallic end cap 17 of an adjacent can, 11A. Optionally with or without the application of glue between 13 and 17, their abutting rims are tautly encompassed by the adhesive band 15, and portions of this band are stretched to tightly grip outer surfaces of the rim of plastic cap 13 and outer surfaces of the rim of the metallic cap, while other band portions, having smaller radii, adhere to side portions of the rims and cylindrical portions of the two cans. The inventor currently prefers the type of junction between opened and plastic-cap-closed cans of this type that is illustrated in FIG. 4.

FIG. 3 shows a can of the kind which commonly contains paint. Adjacent pairs of this type of cans may be end-joined by any of the joints between can ends of FIGS. 1, 2, 4 and 6 to 10, thus forming an elongated tubular member. This can of FIG. 3 has a lid 19 which snaps within and is frictionally held by the rim 20. The lid has a groove 21; and the can's bottom has a rim which is similar to the rim 20. Optionally, such cans, as well as those of FIGS. 2 and 6 to 10, may be soldered, epoxy-glued or otherwise bonded together in a row; but whether or not this is done the end covers of adjacent pairs of cans of the type of FIG. 3 preferably are encompassed and fastened together by bands 2 of adhesive tape.

The cans 22 of FIG. 6 may be of dense plastic, but preferably they are glass jars or bottles. Each of these containers is preferably filled with insulation of an above-described type and closed at one end by a metal or molded-plastic cap 23. This cap is screwthreaded and sealingly fits on the screwthreaded open end of the can. The caps are fastened together by solder, welding or a layer 24 of epoxy putty, silicone-rubber cement or other bonding material.

The other end of each of the jars or bottles preferably has an annular bulge, 25; and this bulge preferably is gnarled, by forming numerous tiny protuberances 26 on it during the process of its molding. Some jars and bottles now commonly sold have such gnarled bulges; and these may be used; or, alternatively, specially made glass or plastic jars with such bulged and gnarled closed ends may be utilized. As illustrated in the right-hand portion of FIG. 6, each pair of adjacent bulged ends of the jars are fastened together by bands of adhesive tape 15'. These bands, with overlapping ends, are stretched to fit snugly around radially outer portions of the bulge 25 and tiny protuberances 26. When the jars have no bulges at their closed ends their end walls may be roughened by coarse sandpaper or a grinding wheel; and these walls may be fastened together by a layer 24 of epoxy putty or the like. Also, optionally but not preferably, each end wall that is associated with a bulge 25 may be thus roughened and glued to a similar, bulged end of each adjacent jar, before wrapping the bulges with the adhesive tape 15'.

Alternatively, and with or without optional glue 24, each adjacent pair of the end caps 23 or plastic caps 13 and 14 may be fastened together by one or more rod-like elements (rivets or bolts and nuts, 27).

FIG. 8 illustrates an alternative means for fixing cans of equal diameter in an end-joined line. Each of the reinforcement elements 28 may be considered to be: a single wire or rod; a narrow strip of wire netting (for example of hardware cloth, poultry-fence wire or pipe strap); or a channel of mesh of the type disclosed on parallel-axes cans in my U.S. Pat. No. 3,857,215 issued on the application that was copending with the "parent" applications of the present case. These reinforcement elements 28 are fixed by epoxy putty, other pasty glue or solder to the rims of the cans. When the element 28 comprises mesh or pipe strap the portions of glue extend thru its apertures and on the can rims.

The bar or panel of FIG. 10 comprises two juxtaposed elongated rows of cans within a single matrix of plastic material. Optionally, end-joined, equal-diameter cans of the type shown in FIGS. 1 to 8 may be substituted for the cans of FIG. 10.

The bars or panels are completed by sheathing the can rows in a matrix of plastic material, which preferably is porous and thermally insulating. This plastic material optionally may be porous concrete which comprises cement (or portland cement, or lime, portland cement and lime, or epoxy or other cement) mixed with light-weight aggregate, which may be expanded baked clay or shale, vermiculite, ground or shredded foamed plastic, charred sawdust, charcoal and/or coke. But preferably at present this plastic material is foamed plastic.

The matrix may be molded around the rows of cans in a mold of the type generally illustrated in FIG. 1. This mold is exampled as of a size for molding a relatively wide panel. The same type of mold is used in forming the bar of FIGS. 7 and 9, but then it is only a little wider than the desired bar.

The mold comprises four wall elements 30, 31, 32 and 33 (preferably teflon-coated, shown as of wood but optionally made of metal or plastic). The elements 30, 31 and 32 are preferably fixed to each other in upright position, and also to a base member of wood, metal or dense plastic or to a concrete floor. The other wall element, 33, has hinges 35 that are connected to the base member and allow this element to be pivoted downward after the top or lid 36 is swung off from the completed construction element. This lid also has hinges, 37, which permit it to be pivoted upward after the fastening elements 38 are released from the element 39. These fastener elements may comprise a hook 38 which swings downward from its pivot on the element 39 and an eye 40, placed lower than 39 on the wall 33, into which the hook is forced, clamping the lid tightly against the top edges of the walls 30 to 33. Alternatively the hook and eye may be replaced by a toggle-type clamp, having one end fastened to the wall element 33 and the other end on cover 36, or by a motor-operated screw, pivotable into a position over 36, adjacent to 33.

Optionally, the bar or panel may comprise an element-reinforcing piece of plank, plywood or expanded metal as shown at 10 or 12 in copending application Ser. No. 359,800 U.S. Pat. No. 3,878,661), located at the base of the bar. If such piece is used it is laid in the mold as the first step in making the completed bar or panel; and optionally the can rows may be glued or strapped to it. In any event, the method of fabrication of the construction element, with a matrix of foamed plastic, may comprise the following steps:

1. If the desired element is a panel, elongated tubular members 41 are laid at opposite ends of the mold across its width — one or more can rows 41 at each of these ends — and a plurality of the tubular members 42 are then laid in the mold along its length, orthogonally located with respect to the can rows 41. If, on the other hand, an insulated bar is to be made in a narrower mold a single elongated tubular member — for example, the one of FIG. 4 — or else a pair of such members as in FIG. 10 is placed in the mold.
2. The caps or small cover 43 are taken off the mold-inlet holes 44 by removal of the screws 45. (Alternatively, these covers may be hinged, and hooks on the cover are removed from eyes on the lid 36, and the covers then are pivoted off the holes).
3. The lid 36 is clamped tightly and preferably sealingly down on the upper edges of the mold sidewalls by manipulating the fastening elements 39–40.
4. Mixed foam-plastic liquids, in an amount to substantially fill the mold space around the cans, are poured or injected into the mold.
5. The plastic is allowed to expand and set while the mold is closed.
6. The lid 36 is raised and the wall element 33 is pivoted downward.
7. The completed construction element is taken from the mold.

An alternative method, which is currently preferred and usable whether the molding plastic material is foamed plastic or concrete, involves a mold without the small covers 43, and with a lid 36 that is either hinged as shown or operable up and down by a jackscrew having its base fixed to the lid and its upper end fixed to an upper support. In this, currently preferred method, step (1) is the same as step (1) above and the other steps are:

2. The lid is removed from covering the mold box.
3. While the lid is out of the way the molding plastic materials (foam-plastic liquids or very-fluent concrete materials of the above-described type), in an amount to substantially fill or slightly overfill the mold, are poured into the mold and around the can rows. The cans tend to float upward in the plastic materials. When the plastic molding materials comprise calcareous or other dense cement, the mold may be only partially filled with these materials, as described in parent appliation Ser. No. 359,800, thus providing a light-weight panel or bar that may be easily stuccoed over in a wall.
4. The lid is closed tightly down on the upper mold-sidewall edges. When the molding materials are expanding foam-plastic liquids which have the capability of slightly overfilling the mold this step 4 should be taken before the plastic completely expands and sets. When, on the other hand, the molding materials are calcareous or other cement and light-weight and overfills the mold, aggregate, the closing of the lid spills out of the mold the surplus of the fluent concrete, and at the same time forces the floating can rows down into nearly complete imbedment in the concrete.
5. The plastic materials are allowed to set.
6. The mold lid is raised and the wall element 33 is pivoted downward.
7. The completed construction element is taken from the mold.

In FIG. 7, the wall portion 46 is part of a layer of mortar which may be considered to be between the can row 47 and a concrete slab or footing, or between this can row and another can row (not shown) which is part of an upright wall, a ceiling, floor or roof. In making an upright wall the following steps are taken: (1) the mortar layer 46 is placed on a concrete slab or footing; (2) the bar 47 is placed on this plastic mortar; (3) the mortar 48 is troweled or otherwise placed on the can row 47; (4) the next bar 49 is laid on the fresh mortar layer 48; another layer of mortar is placed on the tubular member 49; (5) in succession, other bars and mortar layers are laid until the desired height of the wall is reached; (6) one or both of the surfaces of the wall that has been formed are stuccoed with cement and fine aggregate or coated with paint.

In making a ceiling or floor, the mortar 46 is placed on a top or lower portion of a upright wall (between the can row 47 and the upright-wall portion); and considering FIG. 7 as in horizontal section, the mortar layers and bars 48 et seq. of the above steps (2) to (6) are completed, with step (5) ending with mortar between the last horizontal bar and another upright wall. In making a roof an outer slanted bar 49 (eventually stuccoed on its vertical outer surface) is laid on an outer edge of an upright wall, with overhang at an eaves portion; and steps (2) to (6) are taken, with slanted bars and mortar layers, and with step (5) finishing the tubular roof frame.

Various modifications of the structure may be made within the scope of the following claims. For example, the mold lid may be of sufficient weight to be closed against expansion of the foam-plastic liquids, or in removing surplus concrete or forcing it to slightly indent can sidewalls. This lid for instance may comprise: a sheet of plywood (coated with teflon on its lower surface) or a stiff plate of metal or dense plastic; and optionally a weight (iron or lead bars or a sheet of lead) may be fixed to the top of the lid proper.

In the claims, unless otherwise qualified: the word "can" signifies a hollow article or receptacle having at least one end closure, of any material (for example of metal, glass or plastic); "plastic material" means any natural or synthetic plastic (including cement — portland, epoxy or the like — with or without aggregate; and "wall" means an upright wall, ceiling, floor or roof.

I claim:

1. As a light-weight article of commerce, an elongated, easily transportable wall element, adapted for assembly with other, similar elements in a desired structure and for receiving surfacing material after said assembly, the said wall element including:

at least one elongated row of cans, end-joined in a line, each of said cans consisting of a tube and a pair of end elements on opposite ends of the tube, at least one of said end elements being a closure for said tube; each adjacent pair of said end elements being adjoined;

thermally insulating material in said cans;

means fastening each adjacent pair of said end elements together, comprising adhesive tape around the adjoined elements, stiffening and strengthening said elongated row of cans against breaking apart; and a matrix of shape-holding, plastic material, in which said cans are imbedded; two opposite surfaces of said matrix being shaped to substantially conform to opposite surfaces of said desired structure.

2. As an article of commerce, an easily transportable wall member, adapted for assembly with other, similar members in a desired structure and for receiving surfacing material after assembly, the said wall member including:

at least one row of cans, end-joined in a line, each of said cans comprising a tube and a pair of end elements at opposite ends of said tube; one of said end elements being a closure element for said tube; the other of said elements defining an opening into the can and being closely adjacent to a said closing element of an adjoining can;

strength-providing fastening means, comprising can-encompassing adhesive tape, connecting each of said opening-defining end elements at the junction of a said pair to a said closure element; and a matrix of porous, insulating, shape-holding, plastic material, in which said cans are imbedded, porous surfaces of said matrix being adapted to hold wall-finishing material.

3. An article as set forth in claim 2, including: in said matrix, a plurality of rows of said end-joined cans; insulating material in said cans; and a substantially planar piece of stiff, strength-providing material, on which the said matrix and plurality of rows are mounted;

the said fastening means between each pair of adjoining cans comprising: a plastic cap fastened to said opening-defining end element and closing a said opening; and means attaching said plastic cap to a said adjacent closure element.

4. The article set forth in claim 1, combined with other, similar articles in a wall; the said wall further including: layers of mortar between adjacent pairs of said articles; and wall-finishing material on said matrix surfaces.

5. An article as set forth in claim 1, in which: said cans are used, opened cans, and the said pair of end elements of each can includes: a metallic end plate at one end of the can; and a plastic cap at the other, opened end of the can, holding said thermally-insulating material within the said can tube.

6. An article as set forth in claim 5, in which: some of the adjacent pairs of said end-joined can-end elements include contiguous pairs of said metallic end plates; and at least some of the adjacent pairs of can-end elements include abutting plastic caps.

7. An article as set forth in claim 1, in which said insulating material in the cans comprises porous material.

8. An article as set forth in claim 1, in which: each of said end elements has a recess extending inward toward the middle of its associated can tube, and has a rim projecting outward from the outlines of said can tube; and the said means fastening each adjacent pair of end elements together comprises a band of said adhesive tape, stretchable and tightly encompassing the said rims of said adjacent end plates; the said bands being stretched in their middle portions and fitting over outer surfaces of said projecting rims and adhering to side surfaces of said rims.

9. An article as set forth in claim 1, in which: each of said cans has glass material; one of said can-end elements is of glass, integral with glass of said can tube; the can includes a bulge and groove of its tube adjacent to said glass end element and has an opening and screwthreaded glass portion at its end opposite from the glass end element; and the other of said can-end elements is a removable cap, screwthreaded and fitting on said screwthreaded glass portion.

10. An article as set forth in claim 6, in which: each of said metallic end plates and each of said plastic caps have rims projecting outward from the outer outlines of said tubes; and said means fastening each adjacent pair of can-end elements together includes a band of said adhesive tape, stretchable and tautly encompassing the rims of each of said contiguous pairs of metallic end plates, and a band of said adhesive tape, stretchable and tautly encompassing the rims of said abutting plastic caps; the said bands being stretched in their middle portions and fitting over outer surfaces of each adjacent pair of the said projecting rims and adhering to side surfaces of said rims.

* * * * *